US005960607A

United States Patent [19]

Bohn et al.

[11] Patent Number: 5,960,607

[45] Date of Patent: Oct. 5, 1999

[54] METHOD AND DEVICE FOR PRODUCING A MAILING ITEM CONTAINING AN ENVELOPE, AND MAILING ITEM

[75] Inventors: Martin Bohn, Reutlingen; Wolfgang Scheller, Oberpleichfeld; Heinz Weidner, Neuffen, all of Germany

[73] Assignee: bielomatik Leuze GmbH & Co., Germany

[21] Appl. No.: 08/956,739

[22] Filed: Oct. 23, 1997

[30] Foreign Application Priority Data

Oct. 23, 1996 [DE] Germany ..... 196 43 756
Dec. 14, 1996 [DE] Germany ..... 196 52 162

[51] Int. Cl.[6] ..... B65B 11/48; B65B 49/00; B65B 57/00

[52] U.S. Cl. ..... 53/53; 53/131.5; 53/206; 53/284.3; 53/569; 53/520; 493/216; 493/921

[58] Field of Search ..... 53/460, 206, 569, 53/284.3, 411, 131.5, 131.4, 131.2, 202, 51, 53, 54, 520, 435; 493/216, 921

[56] References Cited

U.S. PATENT DOCUMENTS

| | | | |
|---|---|---|---|
| 3,557,519 | 1/1971 | Lyon, Jr. | 53/31 |
| 3,743,273 | 7/1973 | Katz et al. | 270/37 |
| 3,808,768 | 5/1974 | Dobbs | 53/31 |
| 3,897,720 | 8/1975 | Hiersteiner | 93/61 R |
| 4,071,997 | 2/1978 | Gunther, Jr. | 493/216 X |
| 4,189,895 | 2/1980 | Volkert et al. | 53/429 |
| 4,201,332 | 5/1980 | Wooten | 229/92 |
| 4,630,768 | 12/1986 | Bradley | 229/92.7 |
| 4,750,609 | 6/1988 | Felis | 206/1.7 |
| 4,787,192 | 11/1988 | Gunther, Jr. | 53/56 |
| 4,852,795 | 8/1989 | Volk, Jr. | 229/92 |
| 4,972,655 | 11/1990 | Ogawa | 53/569 X |
| 5,409,441 | 4/1995 | Muscoplat | 493/223 |
| 5,458,284 | 10/1995 | Haan et al. | 229/304 |
| 5,524,421 | 6/1996 | Nauheimer et al. | 53/460 |
| 5,555,703 | 9/1996 | Gombault et al. | 493/216 X |
| 5,657,529 | 8/1997 | Bohn et al. | 29/563 |
| 5,755,655 | 5/1998 | Bohn et al. | 493/439 |

FOREIGN PATENT DOCUMENTS

| | | |
|---|---|---|
| 0 272 808 A2 | 11/1987 | European Pat. Off. . |
| 0 372 140 A1 | 12/1988 | European Pat. Off. . |
| 0 448 271 A1 | 3/1991 | European Pat. Off. . |
| 0 695 649 A1 | 12/1994 | European Pat. Off. . |
| 2 647 415 A1 | 5/1989 | France . |
| 1 436 853 | 4/1969 | Germany . |
| 28 05 125 A1 | 8/1978 | Germany . |
| 145 904 | 9/1979 | Germany . |
| 29 35 122 A1 | 3/1980 | Germany . |
| 31 06 155 C2 | 1/1982 | Germany . |
| 42 18 280 A1 | 12/1993 | Germany . |
| 195 13 913 A1 | 10/1995 | Germany . |
| 44 13 008 A1 | 10/1995 | Germany . |
| 1 520 983 | 4/1975 | United Kingdom . |

*Primary Examiner*—James F. Coan
*Attorney, Agent, or Firm*—Quarles & Brady

[57] ABSTRACT

From a web of paper a mailing item (10) comprising envelope and contents is printed personalized on a first conveying section (2) in individual stations. After being turned over the web of paper is supplemented, where necessary, by further paper parts, it then being cut to contour laterally and provided with side flaps folded inwards for the envelope. After this, the cut-to-size item is parted as a unit from the web of paper by a cross-cutter (43) and the contents folded on themselves transversely as well as on the cut-to-size item for the envelope. This unit is then diverted at right angles to a second conveying section (3) in which the cover sheets of the envelope are folded open with interposition of the contents, the cover sheets thereby being secured to each other by the side flaps. After this, the envelope opening is closed by the closing flap.

40 Claims, 7 Drawing Sheets

METHOD AND DEVICE FOR PRODUCING A MAILING ITEM CONTAINING AN ENVELOPE, AND MAILING ITEM

TECHNICAL FIELD

The invention relates to a method of producing a mailing item, the method being more particularly suitable for items for direct mailing. Mailing items of this kind bear on the outer side the name and postal address of the addressee visible or printed thereon at all times. This information may be printed on the contents located within the cited outer side, namely on one or more parts of the contents. The outer side is formed by an envelope or wallet. The contents separate from the envelope are formed by one or more letter pages, a card, a reply envelope, an item irregularly shaped or several millimeters thick such as a gimmick or the like.

BACKGROUND OF THE INVENTION

In the production of such mailing items the outer sides or contents parts of all mailing items produced in sequence feature differing information of the aforementioned kind. This information needs to correspond or be the same for each mailing item. This necessitates monitoring or a machine-controlled matching action in keeping a check that each envelope is brought together with the correspond information and then combined into the mailing item. The mailing item can only be opened by a sealing connection being destroyed or damaged. For this purpose the envelope must be torn open or a temporary seal, such as a fugitive seal, released, where applicable without it being destroyed. It is not until then that each part of the contents as a whole can be removed from the envelope.

The cited matching action in bringing the personalizations on the envelope and the contents of the mailing item into agreement is more particularly necessary when these mailing items are prefabricated on separate production or printing machines as endless webs. In these machines the mailing items are produced longitudinally in sequence and in the same sequence as regards the personalization. Following prefabrication the endless webs are transferred again by compacting into separate storages, such as rolls or zig-zag stacks. The storages are then brought together in a further, separate machine and combined into the finished mailing item, where applicable. In this arrangement the personalized endless web is redrawn from the storage and then slit before being cross-cut into individual sheets. The sheets are then each folded crosswise once or several times so that they fit in the envelope which is shorter as compared to their length. At the end of the folding action the folded sheets are stacked one on the other in the folded condition. Likewise, the already prefabricated envelopes subsequently personalized in a separate machine can be collated as regards the personalization in the same sequence as the sheets in a stack separate from the latter, this stack being separate from the sheets.

With a further machine, for example a so-called enveloping machine, the envelopes and contents parts belonging to each other, namely having the same personalization, are removed from the cribbed stacks and compiled. In this arrangement the two cover sheets of the envelope located one on the other leave the unclosed envelope opening still accessible at the top edge of the envelope over the width thereof. To widen the envelope opening the cover sheets need to be spread apart, after which the enveloper or inserter stuffs the contents parts through the envelope opening between the cover sheets. After this, the envelope opening can be closed by folding over a closure flap which is sealed or latched by the cited connection in its closing position. In this method the two cover sheets may be positionally located relative to each other by side flaps transversely adjoining the envelope opening and located between the cover sheets as well as adjoining the ends of the envelope opening. Thus, the envelope is closed or defined by a fold not only at the bottom edge facing away from its opening but also at one or both side edges.

Matching is not necessary when envelope and contents of each mailing item are produced as cross-strips from an endless web and are thus personalized first integrally one adjoined to the other. After this, the side strip of the endless web intended as the contents for the mailing items in sequence can be folded multi-ply once or several times about folding lines using a plough-type folder, these folding lines being located parallel to the longitudinal direction of the endless web. With cuts, oriented transversely to the longitudinal direction of the endless web the contents strips are then sub-divided into single contents sections which follow each other in sequence and are narrower than the envelope. The width extension of the envelope lies parallel to the longitudinal direction of the endless web, whereby the side or marginal strip intended for producing the envelope directly adjoins the contents strip, namely expediently with the top edge of one of its cover sheets, more particularly the rear sheet.

The folded contents strip is then folded about a folding line parallel to the longitudinal direction of the endless web onto the inner side of the corresponding cover sheet or to the envelope strip still spread out in a single plane. After this, the contents strip is parted in this position from the envelope strip by a cut parallel to the longitudinal direction of the endless web. This is followed by the envelope strip being folded two-ply together with the folded contents strip about a folding line parallel to the longitudinal direction of the endless web, as a result of which the contents are located in position relative to the envelope strip totally between the folded strips. These folded strips are intended for production of the two cover sheets of each envelope. The envelopes which until this time are still in one piece in the longitudinal direction of the endless web are then parted from each other by cuts transversely to the longitudinal direction, namely in producing the side edges of the envelopes. This results in the separated and singled mailing items being created. It is here, however, that the inner sides of the cover sheets are secured to each other in the region of the side edges directly by bonding or the like, this being the reason why no side flaps or folds are provided on the side edges of the envelope. The envelope features such folds only at the bottom and top edge. The working width of the machine or the width of the endless web also limit the size in the contents or the number of contents parts.

OBJECT OF THE INVENTION

The invention is based on the object of defining a method, a device and a mailing item by means of which the drawbacks of known configurations or of the kind as described are obviated. Furthermore, it is intended to achieve the advantages of the kind as explained. In addition to this, it is intended to assure simple and high-quality production of such mailing items whilst reliably matching the personalization of the mailing parts of each mailing item.

SUMMARY OF THE INVENTION

The single envelope is produced with a side flap arrangement during a transport movement or the like. At least one contents part or all contents parts of the contents as a whole of the individual mailing item are arranged at the inner side of at least one cover sheet of the corresponding single envelope at the latest when the cover sheets protruding away from each other are placed one on the other in the closing position. The single contents part can be placed on this inner side when the cover sheets are still spread out in the same plane or when the cover sheets are swivelled about a folding line relative to each other such that they stand transversely or at right angles to each other and their inner sides thus define a re-entering angle. In this arrangement, cut-to-size envelope items following each other directly in sequence are expediently already separated, i.e. singled from each other. However, their cover sheets have yet to be placed on each other in the closing position. A side flap arrangement may be understood to be all side flaps engaging between the cover sheets on one or both side edges of the envelope and emanating from a fold parallel to a corresponding side edge at one or both side edges, this fold forming this side edge of the envelope. At the single side edge only one side flap or two or more side flaps in line with each other may be provided parallel to the side edge in sequence. Each individual side flap may be folded over on itself or folded two-ply Z-shaped. In the case of a Z fold both folds of the flap in parallel, laterally offset relative to each other enable the cover sheets to be totally lifted from each other also in the region of this side edge with stretching of the flap or fold.

The contents part is, where applicable already prefolded, expediently first placed on the inner side of the second cover sheet which is preferably formed by the rear sheet of the envelope, but which may also be formed by the front sheet thereof or the like. The rear sheet forms the back of the finished envelope or mailing item and the front sheet forms the personalized face thereof. The first cover sheet is expediently wider or large in surface area than the second cover sheet. The first cover sheet comprises a closing flap located transversely to the side flaps. To close the envelope the closing flap is folded over its opening onto the outer side of the second cover sheet and directly affixed thereto. Side flaps for mutually connecting the cover sheets may be provided, or only on, the rear sheet, the width of which is then expediently the same as that of the front sheet.

The side flap or arrangement thereof may adjoin only one cover sheet or both cover sheets in the cut-to-size item of the envelope. Over its folding zone the side flap expediently adjoins the first cover sheet directly. The side flap is to advantage already folded out of the plane of this corresponding cover sheet, namely folded inwards transversely or parallel to this cover sheet, whilst the contents part or the contents as a whole are placed against the inner side of this cover sheet. The single side edge of the contents is thus staggered relative to the free, inwardly oriented longitudinal edge of the corresponding side flap. Thus, in this placement the contents cannot come into contact with this side flap. Its longitudinal edge may be located parallel to the corresponding fold. However, the side flap may be placed transversely relative to the corresponding cover sheet or lie in the cut-to-size item plane thereof, whilst the contents part or the contents as a whole is placed against the inner side of this cover sheet. When the side flap is then first folded inwards, the contents can be clamped thereby against the inner side of this cover sheet in further transport and highly accurately located in place thereby. In addition, the greatest width of the contents can be located in the vicinity of the width of each of the two cover sheets thereby, as a result of which any mutual side shift between the two mailing items is eliminated by abutment against the inner side of the flap fold.

The extent of the mailing parts parallel to the side edges or the number of the mailing items parted from the same web of material for the single mailing item can be selected to any degree, e.g. by these mailing parts being prefabricated juxtaposed in the longitudinal direction of the web of material and then being singled by separating them from each other with subsequent collation into the finished mailing item. As regards mailing parts included in the web of material as parts fully spread, cut-to-size or as blanks the web of material is thus conveyed in the direction of the side edges of all mailing parts of the mailing items. Mailing parts directly juxtaposed thus adjoin in this first conveying direction with portions which are intended for production of edges of these mailing items located transversely to these side edges, for instance, for a producing a top edge of one of the cover sheets or the closing flap of the other cover sheet or for producing a top or bottom edge of a contents sheet.

This also applies to juxtaposed part units, each of which is intended for producing several mailing parts for the same single mailing item and are conveyed in common with the endless web or are formed thereby. These part units receive the desired non-linear contouring initially only at their longitudinal sides facing away from each other by they being parted from the web of material, as a result of which the part units run on as endless strips. In this arrangement two or more endless strips the same and laterally adjoining are parted from the same web of material in a multi-use mode of working. Each endless strip is intended for the production of the same, but differingly personalized, part units, it not being until afterwards and in a continuation of the first conveying direction that the part units following each other in sequence in the conveying direction, but not the differing mailing parts of the individual part unit, are separated from each other.

It is still when a contents part or several contents parts is/are connected to the cut-to-size envelope item or directly with each other, e.g. integrally or by bonding, that they can be folded about folding lines located transversely to the first conveying direction so that the single contents part is only two or three-ply. In this arrangement the part unit may be moved in the first conveying direction and shortened by the fold parallel to this first conveying direction. In the same folding procedure the contents part can also be folded onto the corresponding first or second or leading cover sheet. Should this cover sheet comprise side flaps, they are thereby upswept so as to deposit the contents part thereon past the cover sheet. If the trailing cover sheet comprises side flaps, they may thereby already be swept down. The side flaps of the leading cover sheet are expediently folded during the continuation of the first conveying movement inwards onto the folded contents part, i.e. whilst the trailing cover sheet is still clasped in the folding device for the contents part and is thus located in position during passage of the part unit. In a directly subsequent continuation of this conveying movement the glue or the like is applied to secure the side flaps and thereby a corresponding tackiness generated. Expediently this tackiness is produced not on the side flaps or on the leading cover sheet, but in corresponding defined portions on the inner side of trailing cover sheet downstream of the folding device, as a result of which the side flaps can be pressed against the contents part without soiling the hold-down, provided for this purpose, with adhesive.

After singling, the part units are expediently further transported in a second conveying direction at right angles transversely to the first conveying direction on a second conveying section likewise parallel to their ply plane, namely now at right angles transversely to the side edges of their mailing parts. The transition between the two conveying movements located transversely to each other occurs preferably continually by the individual part unit being defined at the end of the first conveying movement by a stop against this conveying movement, it thereby or immediately thereafter already being moved further, i.e. substantially without standstill, in the second conveying direction. This diversion in the conveying movement occurs directly after the cited folding action of the contents part in a direction parallel to the folds thereof. When in-folded side flaps or the contents part are located as near as possible to the leading end of the part unit, they act at the stop at the end of the first conveying movement like side U-shaped stiffening profiles against becoming crunched, as a result of which the stop or conveying speed can be increased without the risk of damage.

During the second conveying movement two or more processing actions mutually staggered transversely to this movement, but parallel to the second conveying direction are carried out simultaneously on the single part unit, for example a parting cut, scoring a fold notch or the like, as a result of which the singled part unit is well guided and prevented from turning out of place in the conveying plane. By the parting cut the edges of the mailing parts of the individual part unit can be likewise produced which are explained on the basis of the cross separation in the first conveying section. In addition to this, material parts can be separated from the part unit by this cross cut or by the parting cut and carried away from the mailing parts as waste. The material part carries corresponding markings and is two-ply, each ply being marked. In this arrangement the two plies are also connected to each other located in position by a bond or the like, as a result of which the plies can be moved away in common from the cut-to-size items continuing in transport, e.g. by being suctioned away from one side only, whereby the one, upper ply of the material part does not pass through uninterrupted like the other, instead the upper ply may be formed by a sequence of longitudinal sections spaced away from each other longitudinally.

The mailing item in accordance with the invention comprises at least one contents part or a contents array as a complete contents arranged removable in the envelope. With the side flap arrangement totally folded inwards the contents are placed past the longitudinal edge sections of this arrangement without curvature or in the flat condition directly onto the inner side of the corresponding cover sheet whilst the cover sheets have yet to come into contact with each other. In this arrangement the placement movement is oriented at right angles transversely to the planes of this contents array as well as to this cover sheet. It is of advantage when the contents array is located inwards or towards the middle of the envelope width laterally offset relative to the longitudinal edge of each side flap also in the finished condition of the mailing item. This longitudinal edge can namely prevent the contents from slipping sideways between the side flap located there and the cover sheet connected thereto merely by the fold also when being conveyed in the second conveying direction, although this can also be attained by bumping up the mailing item with this side edge.

Advantageously, the side flap arrangement is prefolded inwards during the first conveying movement before being reopened outwards at least in part prior to transverse separation of the part units and in conclusion being again folded inwards into its final position after this cross parting. Clamping the contents part in place with the side flap can then be maintained as of this moment until a further contents part is inserted or the cover sheets are then translated into the closing position in line with each other.

The device in accordance with the invention comprises a conveying path for the material or material path in which the material is expediently moved during all of the cited processing actions substantially or continuous throughout all processing stations which implement the processing actions as explained. In this arrangement the continual movement may occur up to and during each of the processing actions. Practically up to singling or transversely parting the part units the web of material is lengthwise as well as widthwise consistently tensioned throughout as of an infeed following a storage. The conveying movement occurs in each case over the full first conveying section and over the complete second conveying section continually and may be just as fast in the second conveying section as in the first conveying section or slightly faster as compared to the latter. Within each conveying section the material may be deflected several times transversely to the conveying plane. The general conveying planes of the two conveying sections are located expediently parallel, more particularly horizontally. It is in these planes that the nips of substantially all processing stations are located.

The device is configured expediently in accordance with the U.S. patent application Ser. 08/399,840, to the features and effects of which reference is made in they being incorporated in the present application. As regards the devices for folding the side flaps, the cover sheets and the closing flap reference is made corresponding to the U.S. patent application Ser. 08/409,504 or U.S. patent application Ser. 08/892,748.

BRIEF DESCRIPTION OF THE DRAWINGS

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present. Example embodiments of the invention are explained in more detail in the following and illustrated in the drawings in which.

DETAILED DESCRIPTION OF THE PREFERRED EMBODIMENTS

Figure 10:
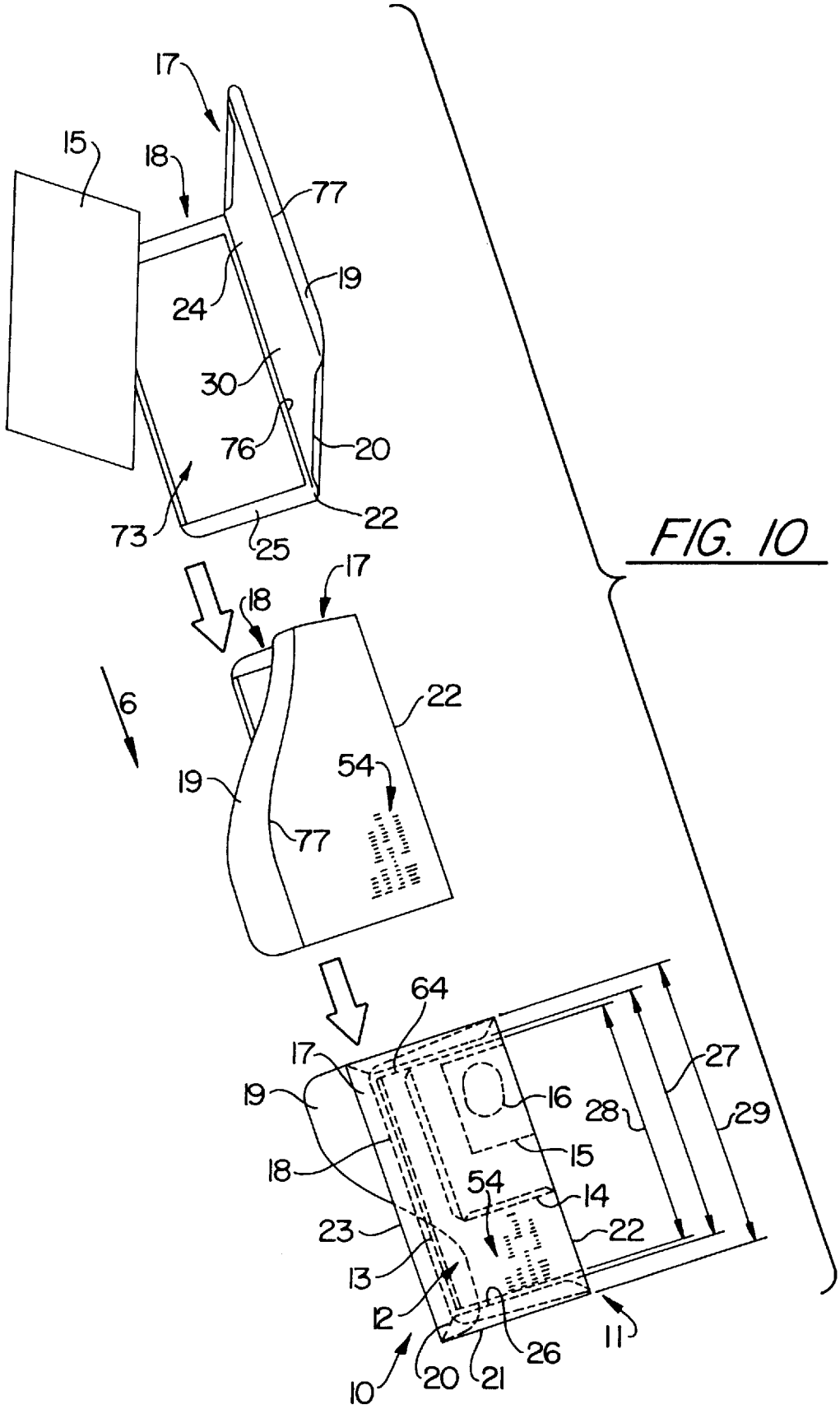

The device 1 is configured as a production line having two or more portions conveying at right angles to each other, it comprising a longer conveying section 2 having conveying direction 5 and a shorter conveying section 3 having conveying direction 6. The conveying planes 4 of the two sections 2, 3 are the same or in parallel. At the start of the first conveying section 2 stands a storage 7 in the form of a reel of paper mounted to rotate about an axis parallel to the horizontal plane 4 and at right angles to the first conveying direction 5. The web of paper drawn from the storage 7 enters as material in an infeed 8 and is continually moved without interruption to an outfeed 9. At the outfeed 9 the finished mailing items 10 are placed stacked one on the other in sequence as shown in FIG. 10.

Figure 17:
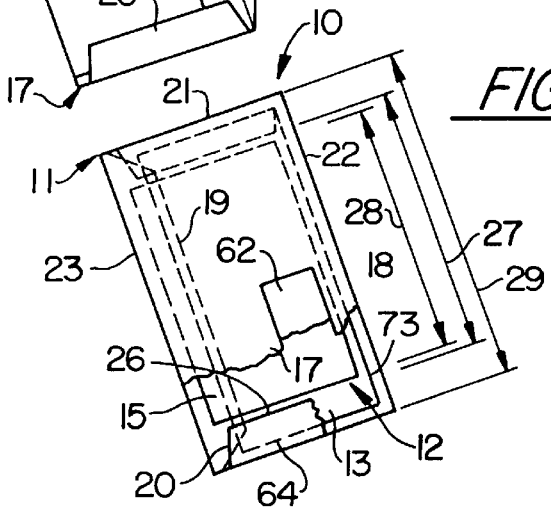

The mailing item 10 consists of several mailing parts, namely an envelope 11 and the complete contents 12 thereof. The latter may involve as contents parts a sheet of information or a letter 13, a return envelope 14, an attachment in the form of a card, a prospectus or the like, an irregularly shaped object 16 and the like. The envelope 11 comprises two cover sheets located one on the other in the closed position, as shown in FIG. 10 or 17, namely a front sheet 17 defining its surface area size and a smaller or same-size rear sheet 18 as well as a closing flap 19 directly adjoining the cover sheet 17. The flap 19 is used to close the opening of the envelope. Directly and integrally adjoining the cover sheet 17 or 18 are two side flaps 20 located opposite each other. These are oriented against each other, engaging on both sides between the cover sheets 17, 18 and join the cover sheets 17, 18 fixedly to each other only in their side portions. In the closed condition ready for mailing the mailing item 10 features four each straight contour edges located at right angles to each other, namely two side edges 21 parallel to each other as well as transverse edges parallel to each other, these being the bottom edge 22 and a top edge 23. All edges 21 to 23 are each formed by the back of a fold. The fold in each case joins at each of the side edges 21 the cover sheet 17 or 18 to the corresponding flap 20, at the edge 22 the cover sheet 17 to the cover sheet 18 and at the edge 23 the cover sheet 17 to the closing flap 19.

The contents 12 are located totally between the inner sides 24, 25 of the cover sheets 17, 18 and, as viewing the plane of the closed envelope 11, are smaller in surface area than that of the envelope or of each of the cover sheets 17, 18. Facing away from the fold 21 each flap 20 forms a longitudinal edge 26 which is parallel to the fold 21 or to the corresponding center plane of the envelope 11 and linearly extends full-length over the majority of the height spacing between the edges 22, 23. As shown in FIG. 10 the smallest spacing 27 between these edges 26 parallel to each other is slightly larger than the corresponding width 28 of the contents 12 and smaller than the width 29 of the envelope 11, as a result of which at the inner side 24 of the cover sheet 17 a cover sheet zone 30 is formed free of flaps 20. The zone 30 extends over the full height of the cover sheets 17, 18. In the zone 30 the contents 12 are directly in contact with both the cover sheet 17 and the cover sheet 18. Located adjacent to the zone 30 the flaps 20 adjoin the inner sides 24, 25 of the cover sheets 17, 18 directly, as a result of which the mailing item 10 or the envelope 11 is only three-ply at this location.

Figure 14:
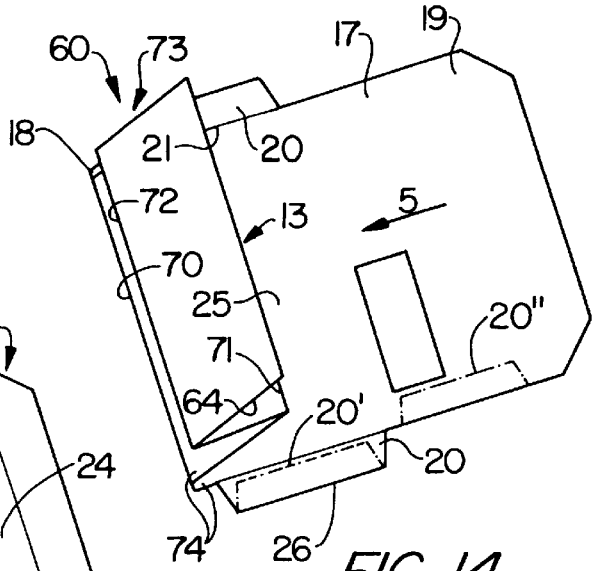
Figure 15:
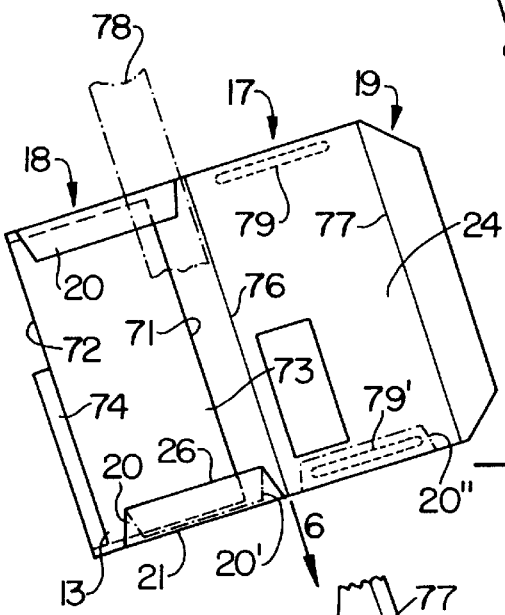

In the case of the mailing item 10 as shown in FIG. 17 the width of the contents part 13 is substantially more than the widths 27, 28 and only unsubstantially less than the width 29, as a result of which the contents part 13 engages on both sides between the flaps 20 and the inner side 25. It is here, namely, that the flaps 20 each adjoin via the fold 21 only the cover sheet 18 and are secured by its sides facing away from the inner side 25 and the contents part 13 bondingly to the inner side 24. Indicated dot-dashed at the bottom in each of the FIGS. 14 and 15 is a flap arrangement which enables the cover sheets 17, 18 to be lifted from each other transversely to their planes even after the connection via the side flaps in the region of of their corresponding side edges, whilst the arrangement 20 is expanded like a bellows. In most cases the same arrangements 20 are provided on both sides of the envelope 11.

Figure 8:
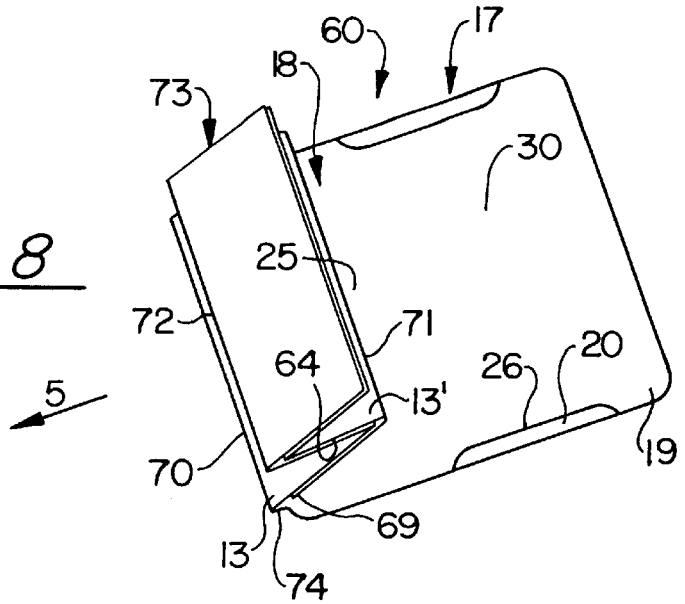
Figure 9:
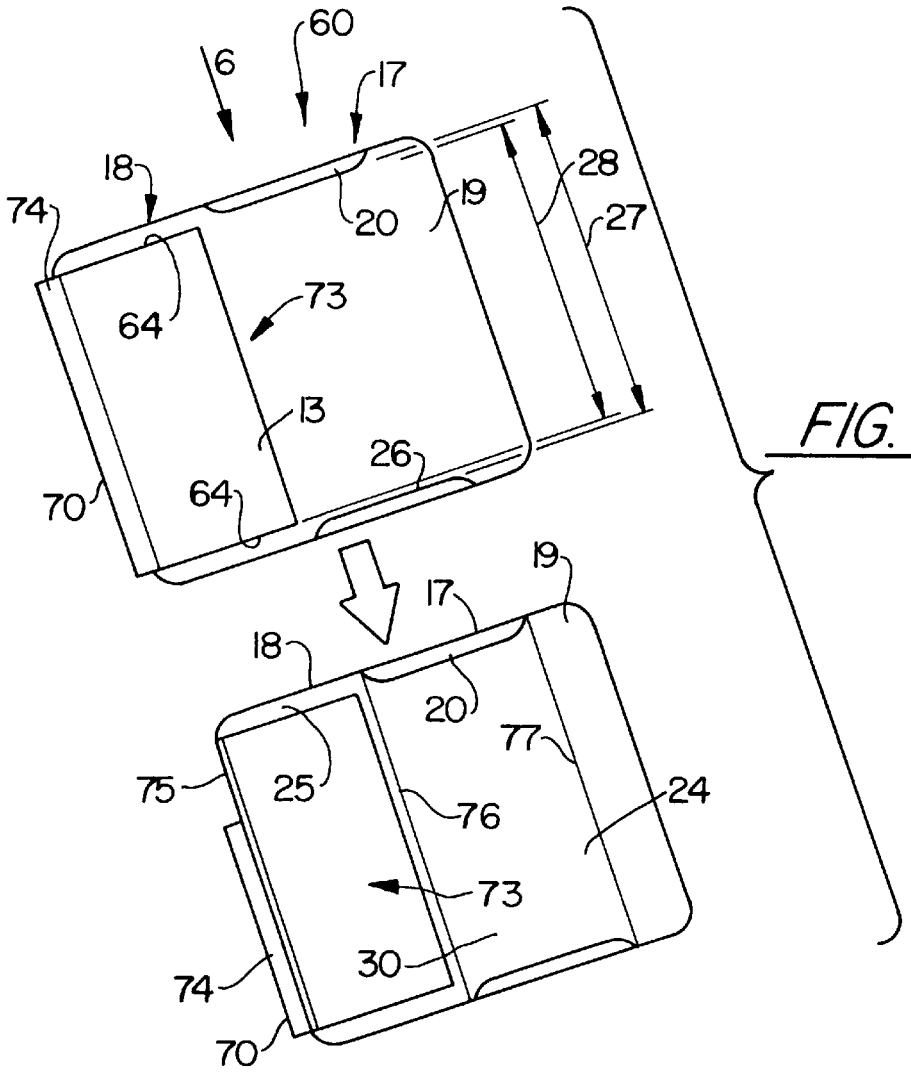

To form such a Z fold the side flap 20 adjoins by its longitudinal edge 26, via a fold, a further flap 20' which in the finished condition of the mailing item 10 locates on the side of the flap 20 facing away from the corresponding inner side 25, is oriented outwardly from the fold 26, but not protruding beyond the edge 21 and is set back by its ends relative to the ends of the flap 20. The folded-in flap 20" of the other cover sheet 17 corresponding to the flaps 20' as shown in FIGS. 8 to 10 is located on the flap 20 to which and only to which it is directly secured. As a result of this arrangement the flap 20' is located between the flaps 20, 20". By spreading all folds of the flaps 20, 20', 20" and in maintaining the parallel location of the cover sheets 17, 18 the latter can be moved transversely relative to each other. The cover sheets 17, 18 are the same in width, as a result of which their side edges 21 locate coincidently. The side flaps do not protrude beyond the edges 21.

The parts 11, 13 are produced on the fly simultaneously from the same, single-ply material or web of paper 31 which is unreeled from the storage 7. From the storage 7 the web 31 gains access to the processing stations 32 to 43 in a continual conveying movement, after which the material which is singled into a likewise continual sequence of part units passes through further processing stations 44 to 49. Directly adjacent to the side flap reel 7 the web 31 is defined in a conveying drive 32 which draws it from the reel and locates it in position in passing through so that it is subjected to a constant tensile stress throughout up to the station 42. The station 42 works as described on the basis of the station 32 as a driving means at the downstream end of the tensioned web 31.

Figure 2:
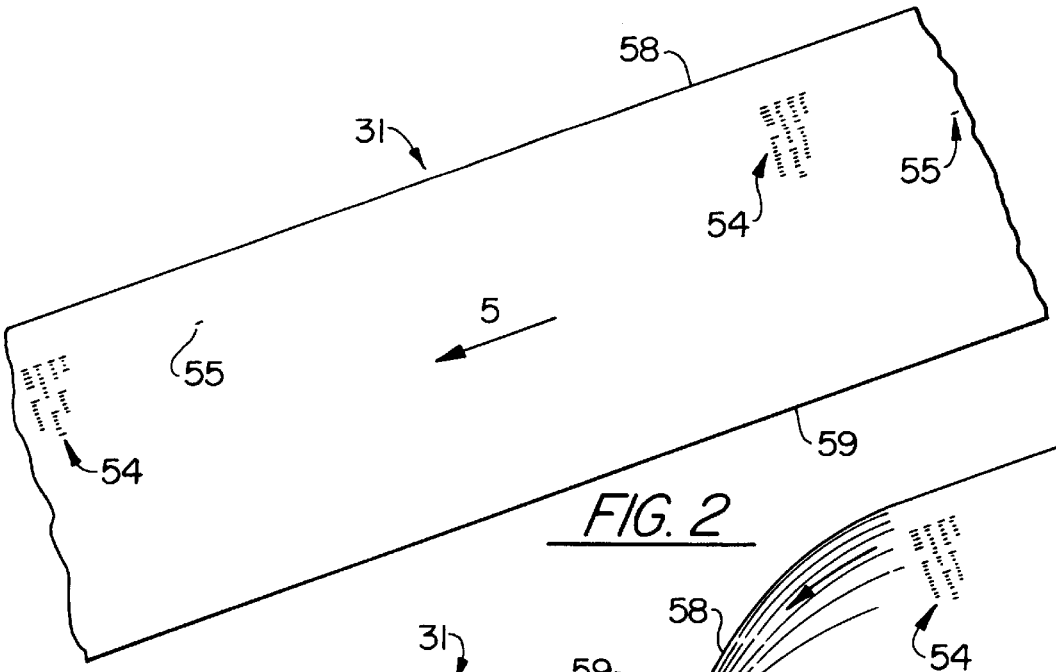
FIGS. 2 to 10 show the sequence of steps in the method of producing the mailing item ready for mailing and FIGS. 11 to 17 show a further possibility in the sequence of steps in the method.
Figure 3:
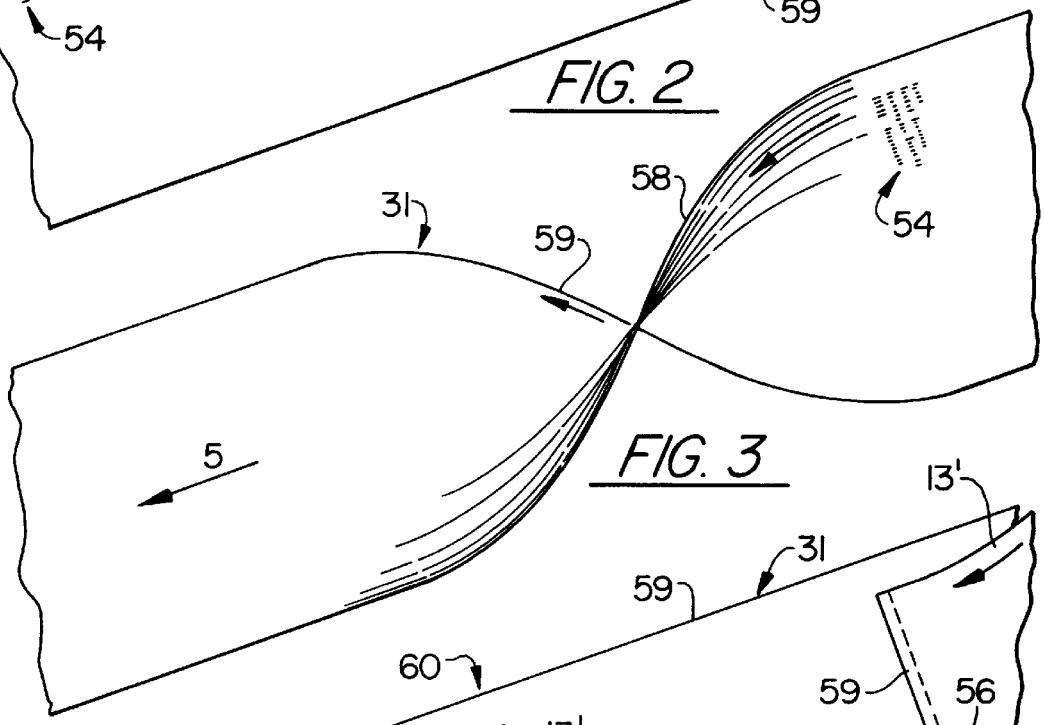
Figure 4:
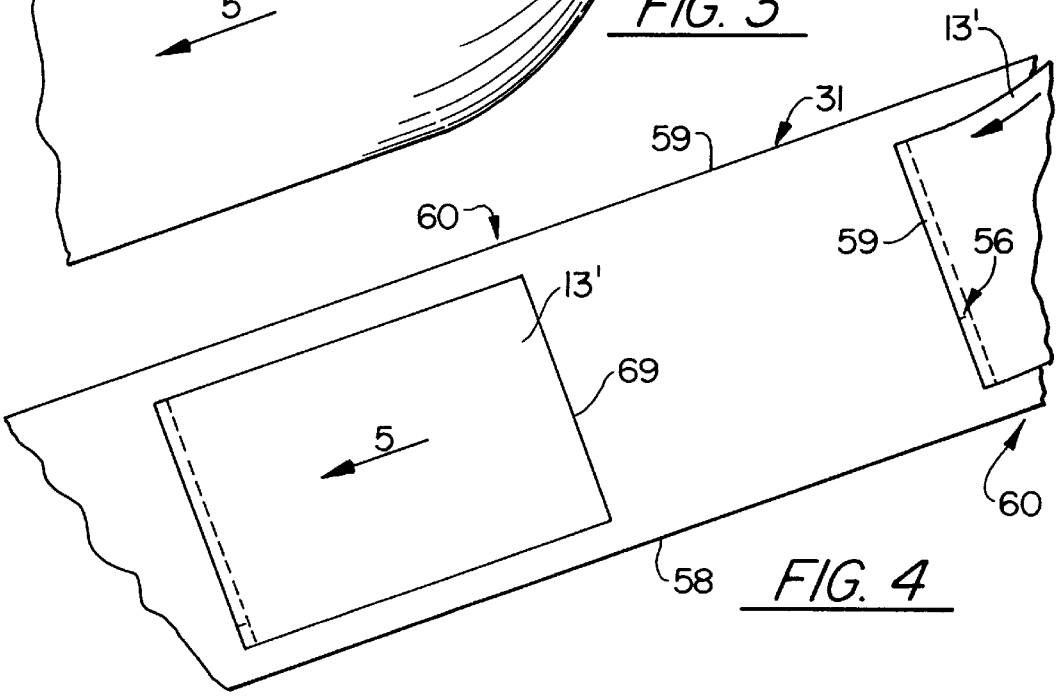

Provided directly following the infeed 8 is a dispensing station 33 with which labels, postage stamps or the like are applied to the face of the web 31 and affixed thereto. This is followed next by a printer 34 for personalized printing the face of the web 31 as shown in FIG. 2. This print may be included already on the web taken from the storage 7. The next to follow is a dryer 35 for thermally drying the printed ink. The next station following is a turnover device 36 in which the web 31 is turned first from the plane 4 and then skew to the direction 15 as well as back into the plane 4, as a result of which the web surface area formerly located underneath is now on the top and the face printed before or provided with applications is now located underneath.

Directly following the above is an applicator 37 for a fixitive or adhesive, such as glue, with which in equal longitudinally spacings adhesive cross strips are applied or pressed onto the face of the web 31. This is followed directly again by a dispenser 38 with which further contents parts 13' are located in equal longitudinally spacings in sequence on the face of the web 31 and located in position with the adhesive strips of the station 37. Located directly adjoining downstream thereof a transfer device 39 for the parts 13' is provided. This unit 39 guides the parts 13' above the web 31 firstly counterwise to the direction 5 to the station 38 in which the parts 13' are diverted transversely to the plane 4 in the direction 5, they thereby being pressed to the face of the web 31 on the fly in the same direction in a nip. In incorporating further features and effects of the stations 38, 39 in the invention reference is made to the U.S. patent application Ser. 08/498,296.

Directly following the stations 38, 39 is a device 40 or punching unit having rotating punching tools for contouring the longitudinal edges of the web 31 as well as, where necessary, to produce cut-outs defined over the periphery full-length by the web 31. Directly following this a folding device 41 which folds the flaps 20 inwards in longitudinal passage is provided. Located directly adjoining this folder 41 downstream is the web pretensioner 42.

Figure 5:
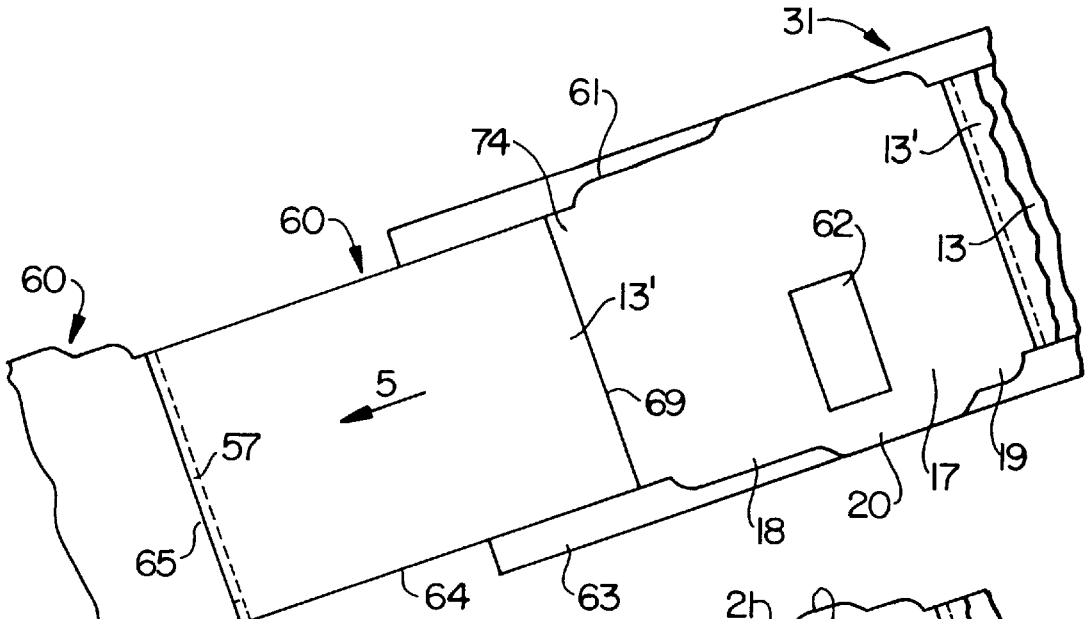
Figure 6:
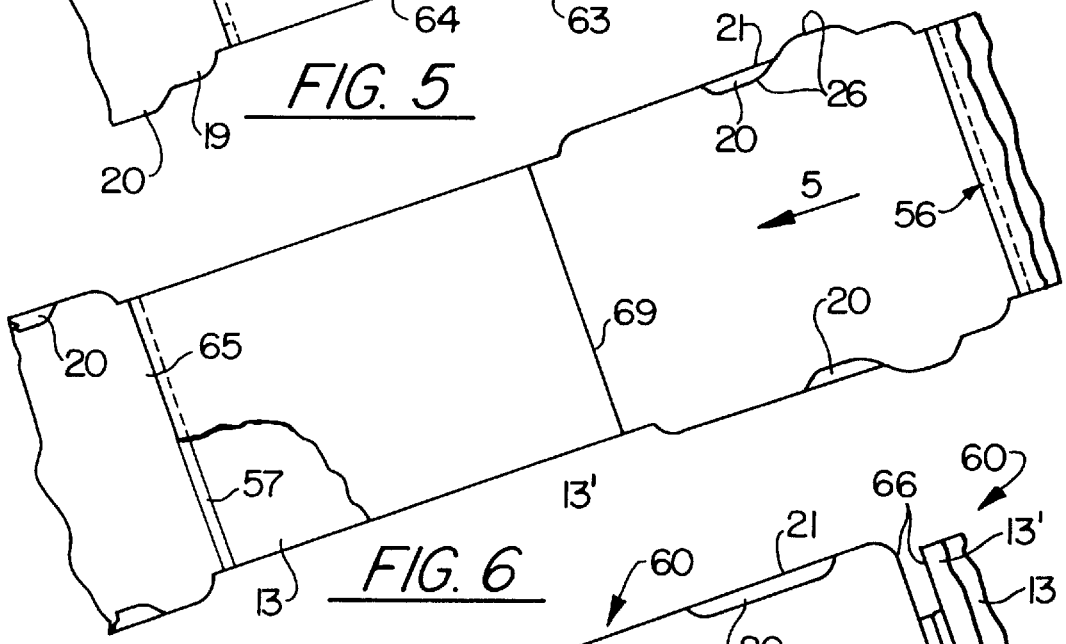
Figure 7:
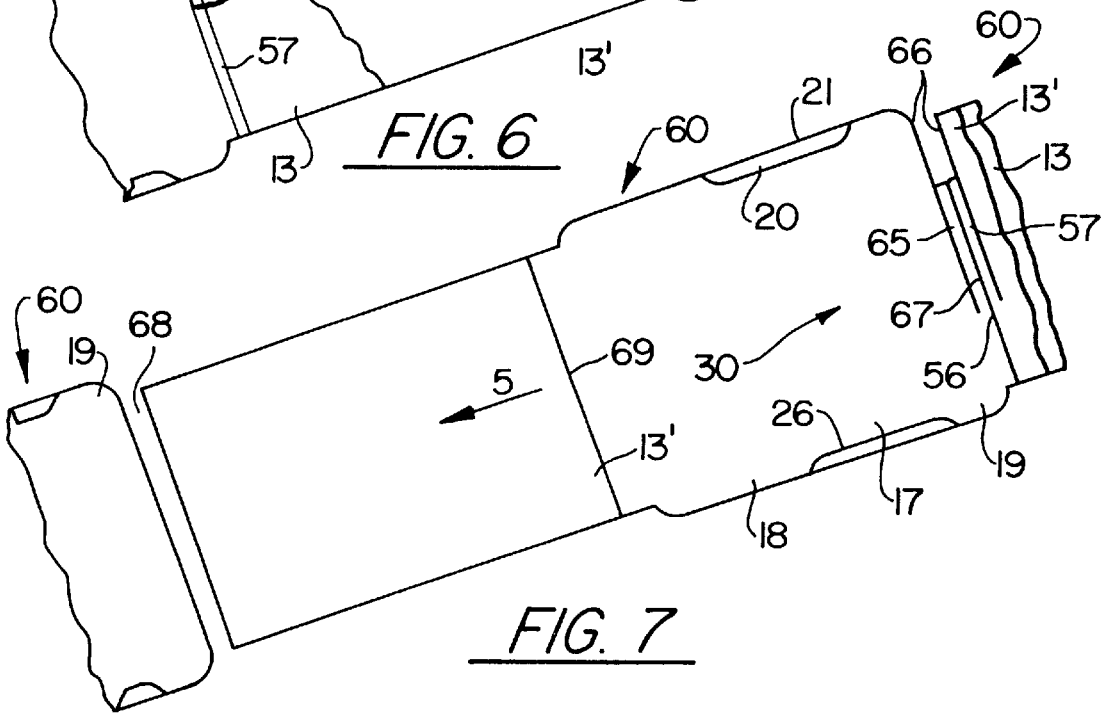

As of leaving the station 40 the web 31 is narrower than before and, where necessary, subdivided into individual webs running alongside each other in the same plane as shown in FIGS. 5 to 7. From station 42 this web or individual webs is/are supplied directly to a device 43 which processes the web on the fly transversely to the direction 5 over its width or changes the configuration of the web, cross cuts being produced, as a result of which the web is subdivided into part units as shown in FIG. 7. These part units leave the station 43 spaced away from each other and are then further transported by the conveyor 44. The conveyor 44 comprises circumferentially driven conveyor belts on which the part units are located. The conveyor 44 may comprise in the direction 5 belt sections following each other in sequence which adjoin each other via a switchpoint 45. Due to the latter, part units not intended for further processing can be ejected transversely to the plane 4 downwards out of the conveying section 2. Downstream of the switchpoint 45 the conveyor 44 delivers the part units to a folding device, e.g. a wallet folder 46 in which the contents parts 13, 13' of each part unit are folded onto the inner side in common into the shape ready for mailing and the flaps 20 longitudinally glued. Immediately after this the part units are diverted by motor drive at the end of the section 2 at right angles in the direction 6 to the section 3 since the start thereof coincides with the end of the section 2. Directly following this station the part units are supplied in direction 6 to a device 47 which simultaneously cuts and scores, the device 47 executing both tasks in a common plane located at right angles to the plane 4 and to the direction 6. These tasks are done parallel to the direction 6 on the fly. From the station 47 the part units are next supplied to a folding station 48 for upsweeping and folding the cover sheets 17, 18 on to each other. Between the ends of this station 48 a means 49 for inserting the contents parts 14 to 16 between the cover sheets 17, 18 may further be provided. At the end of the station 48 the closing flap 19 is folded into the closing position on the fly, thereby sealingly closing the envelope 11. After this, the mailing items 10 thus produced ready for mailing are stacked one on the other into packages on an output shelf, this output shelf 51 forming the exit 9. The downstream end of the conveying section 3 may also adjoin via a diverter a further conveying section located at right angles or transversely to the section, protruding more particularly beyond the same side as the conveying section 2 only and conveying in the opposite direction thereto. The diverter works in the same way by stop and transversely exiting as already described for the diversion between the conveying sections 2, 3.

Standing off from the floor, each of the devices 33 to 44 is arranged non-destructively replaceable, exclusively on the top surface of a common base 52 which solely carries the device, is directly resting on the floor of the building and which is formed by identical base units adjoining each other in the longitudinal direction 5 of the base 52. These base units too, each of which is able to mount two or more devices 33 to 44 in sequence, are non-destructively replaceable. For operation each device 33 to 43 can be arranged on every base unit. The device 44 comprises a separate base unit which differs from those already cited. For mounting every device each base unit comprises on its top surface mounting rails 53 located transversely to the direction 5 and on which each device 33 to 43 can be shifted parallel to the plane 4 and at right angles to the direction 5, as a result of which the device can be removed from the frame 52 or inserted therein and then locked in place by tensioning. Prior to its being locked in place the frame of the device, engaging the beams 53 centrally can be adjusted in location relative to the base 52 by each device being individually slidingly shifted parallel to the plane 4 as well as at right angles to the direction 5 by means of a positioning gear and swivelled about an axis located at right angles to the plane 4.

Each and every device 33 to 43 comprises a frame located totally above the base 52 on which it stands. Mounted in the frame are all tools which in processing engage the material 31 through the device. On its rear side the frame can be connected via a non-destructively releasable drive connection to a drive output. The drive output is mounted below the standing surface areas of the rails 53 on the corresponding base unit. The storage 7 is mounted in a side flap base separate from the base 52 and the individual devices with which it is located on the floor of the building spaced away from the base 52. The side flap base also carries the conveyor drive 32. The conveyor 44 adjoining the end of the base 52 protrudes in the direction 5 beyond the corresponding single base with which, like the individual base units relative to each other, it can be shifted on the floor of the building and replaced relative to all other units in the installation direction of the devices 33 to 43. As a result of this the switchpoint 45 is located outside of the base 52 freely above the floor.

Figure 1:
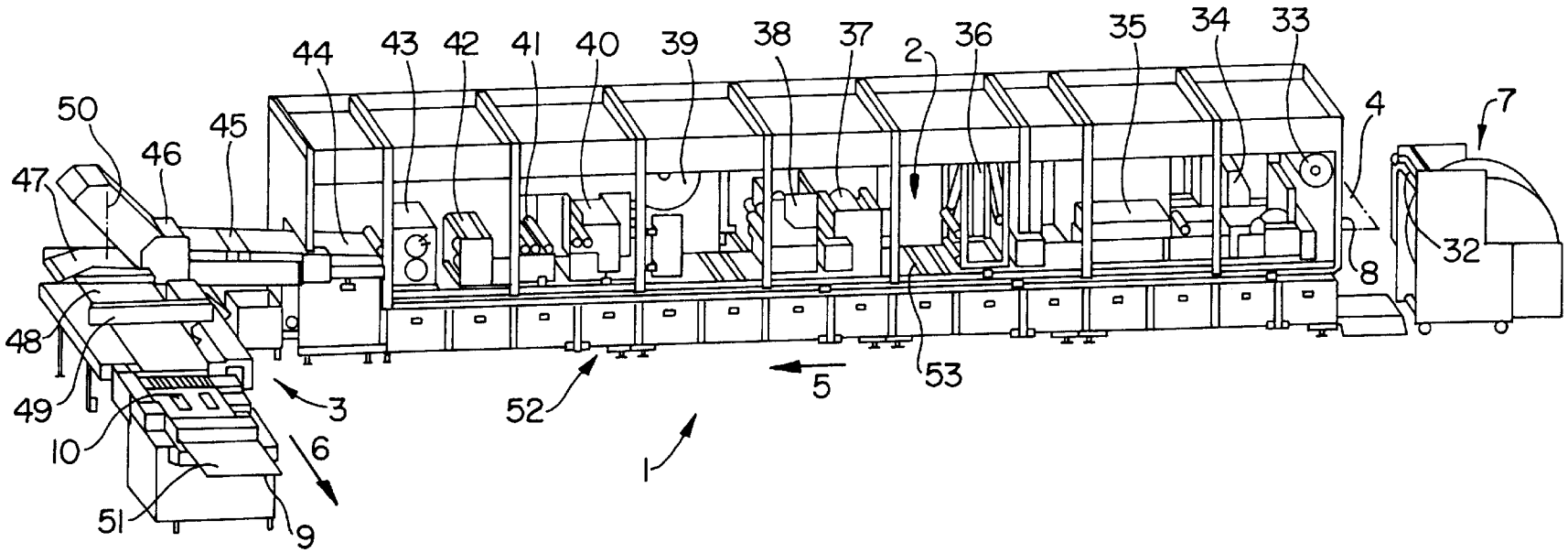
FIG. 1 is a perspective view of a device in accordance with the invention.

All individual devices 47 to 52 of the section 3 are arranged on a common baseframe which is mobile mounted on the floor of the building by running members, such as rollers. This baseframe and the part of the frame carrying the device 46 of section 2 are swivable relative to each other about a vertical axis 50. The axis 50 passes through the diverter station between the two sections 2, 3 in the middle of the working widths of both sections 2, 3 at right angles to the plane 4. During adjustment the section 2 remains unchanged whilst the section 3 including its baseframe is translated either in direction 5 in line with the section 2 or, as shown in FIG. 1, into the position at right angles to the latter. This movement occurs infinitely variable and can be locked in any position, as a result of which the device 1 is suitable in addition to the mode of operation as described with respect to FIGS. 2 to 10 in producing mailing items 10 also for the production of completely different products or mailing items requiring a different sequence of the individual devices 33 to 49 or alignment of the sections 2,3. For instance, processing with a plough-type folder as cited may be undertaken, in which case reference is made to U.S. patent application Ser. No. 08/625,697 regarding incorporation of the features and effects in the invention.

During swivelling, the two section units 2, 3 remain connected to each other in a straight line as well as via an articulated arrangement which defines the axis 50. The units 2, 3 may be separated from each other non-destructively, however, and then recombined in the respective setting. Each of the stations 47, 48, 49, 51 may be formed by a separate module. The module has its own floor runners, such as rollers or casters with which it can be moved in any direction as required on the foundation floor and connected located in position with all respective adjoining processing stations via releasable connecting members and re-disconnected again non-destructively, as a result of which these stations can be added to the end of the section 2 in any arrangement and sequence as required.

The printer 34 is used to print the web 31, as shown in FIG. 2, with differing personalized printings 54 longitudinally spaced in sequence, namely e.g. name and postal address of the addressee in each case. This printing is located on the outer side of the finished envelope or cover sheet 17. At the same time, on the same side of the web, markings 55 are printed, one of which in each case is assigned to the printing 54 and located downstream spaced away therefrom.

Laterally adjacent to the printing 54 a postage stamp or the like may be applied to the outer side of the sheet section 17 previously by the device 33. Using the printer 34 a coding may be printed to the same upper web side, this coding including the zip code belonging to the postal address in each case and which can be machine-read in the region of the output shelf 51, as a result of which the finished mailing items 10 are sorted and machine stacked according to such zip-codes. Once the printing has dried in the device 35 the web, comprising parallel longitudinal edges 58, 59 from the storage 7 up to the device 40, is turned over about its longitudinal centerline in the device 36 so that the printed side is now underneath. Lines of glue are then applied to the side of the web now facing upwards by the device 37 at right angles to the direction 5. These lines are spaced away from the two longitudinal edges 58, 59 and have a length which is slightly less than the width of the parts 13'. Each part 13' is placed individual and spaced away from the other parts 13' on the face of the web so that its frontmost edge zone in the direction 5 totally covers the lines of glue, as a result of which a connecting zone 57 is formed between the material parts 13', 31. The contents part 13' is spaced away from the two longitudinal edges 58, 59 sideways. The part 13' may be just as wide as the web 31. The part 13' may be adhesively connected to the web 31 along both edges 58, 59, as a result of which the intermittent multi-ply parts 62 can be suctioned off with no trouble on cutting.

The glue which connects the plies of the parts 63 only during production, is applied in the station 37 or station 38, 39 prior to placement of the parts 13', more particularly by the same as a rotating roll tool, like the glue line for the connecting zone 57. This tool may carry laterally pliant replaceable cliche projections annular or partly annular in shape of a foamed material or the like. These projections apply the glue only to those zones of the material part 13, 31 which are covered in the station 38, 39 by the parts 13' or are totally removed with the lines 63.

The part 13' is first transferred contrary to the direction 5 in its longitudinal direction progressively to the outer circumference of a permanently rotating roll. At this outer circumference the part 13' is located in position by suction, diverted with the rotary movement downwards over half a full circle and then transferred into the direction 5 in the nip between the aforementioned roll and a companion tool at the same running speed as the web 31. In this arrangement the part 13' is deposited contrary to the direction 5 progressively linearly on the web 31 and released from the roll. The material for the parts 13' is drawn off as an endless web from the storage 39 which may also stand to one side of the base 52 and singled by cross cuts into the parts 13' directly prior to the cited transfer roll. This material may be already printed or personalized on the front and/or rear side. It may be of advantage to apply the adhesive line for the zone 57 not firstly on the web 31 but in the device 38, 39 on the part 13, i.e. expediently prior to the parts 13' being singled by cross-cutting. On each longitudinal section of the web 31 including a printing 54, 55 a part 13' is arranged so that in this case the web 31 is then two-ply. In this arrangement a larger number of plies may be provided by applying further parts 13', each of these longitudinal sections then forming a part unit 60 for producing a single mailing item 10.

Figure 11:
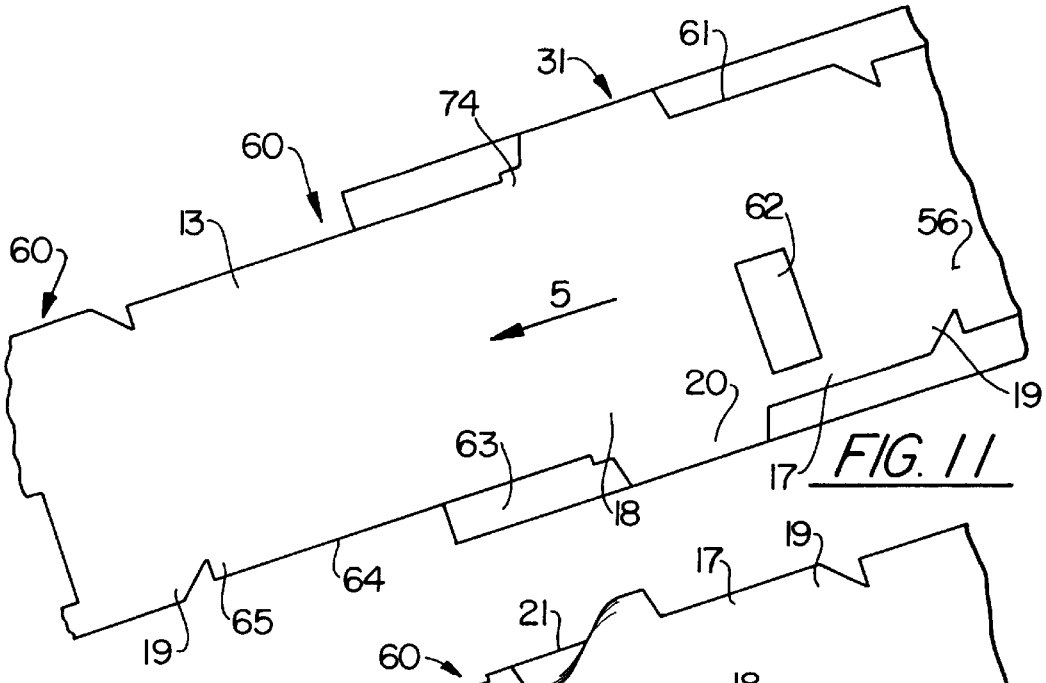

The device 40 comprises a permanently rotating tool roll, it defining by a companion tool a nip for passage of the web 31. Arranged on the outer circumference of the tool roll are replaceable cutting or punching tools. These produce, as shown in FIG. 5 or FIG. 11, on each longitudinal section 60 laterally contour cuts oriented non-linearly or in a departure from the direction 5, thus producing the side edges 61, 64 of each unit 60, namely of the cover sheets 17, 18, flap 19 and the contents part 13', as well as the longitudinal edges 26 and the inclined end edges of the flaps 20. Using this tool a window cutout 62 may be cut out of the cover sheet 17, it being through this cutout that the printing 54 printed in this case on the contents part 13, 13' is visible from without in the finished condition of the mailing item 10. The window cutout 62 may be covered totally by a transparent window layer of see-through paper or the like. This layer is expediently secured or firmly bonded to the inner side 24 in one station following production of the contents 62 in the conveying section 2, this station being arranged in the conveying direction 5 downstream of the stations 33 to 44 or prior to the stations 41 to 48 and operating the same as already explained for station 38, 39. The side edges 64 of the multi-ply part 13, 13' are located parallel to each other. The edges 64 may be produced in a single full-length cut on two or more of these plies 13, 13' in common.

Each side cut totally separates a side strip 63 as well as the side glue application from the web 31 as waste and simultaneously transports it away in the station 40 transversely to the plane 4, the same applying to the parts which are released from the web 31 in producing the contents 62. The unit 60 is now narrowest in the region of the parts 13, 13'. Contrary to the direction 5 the parts 13, 13' of the unit 60 are adjoined by the head portion of the widened cover sheet 18, i.e. via a, in the direction 5 narrow, cross strip 75 of the part 13. The side edges 64 of the part 13 extend beyond the corresponding end 69 of the part 13' up to the cover sheet 18, the strip thus being in this case single-ply. The end 69 of the part 13' may be located in position relative to the part 13 by a further adhesive zone. In the direction 5 adjoining the corresponding end 57 of the parts 13, 13' is the flap 19 of the next unit 60 likewise via an additional strip 65 of the part 13. In the direction 5 the cross strip 65 is shorter than the strip 74. The ends of the strip 65 are formed by the edges 64. The flap 19 is wider than the parts 13, 13', as a result of which the flap 19, like the cover sheets 17, 18 and the flap 20 protrude laterally beyond the corresponding side edge 64. The parts 13, 13- lead the cover sheets 17, 18 and the cover sheet 18 leads the cover sheet 17.

Now, all units 60 following in sequence are the same in shape and length. The individual unit 60 may be further supplemented by a flat cut-to-size item for a card 15, an envelope 14 or the like, the card adjoining the front end of the part 13 remote from the cover sheets 17, 18 via a parting perforation. Adjoining the front end of the card is the cut-to-size item for the envelope 14 with its closing flap via a parting perforation, the front end of this cut-to-size item adjoining via the strip 65 the next unit 60. The cut-to-size item is the same in width as the part 13 and wider than the card 15. A part 13' may also adjoin the front end of the part 13 or of the unit 60 integrally via an intermediate strip configured corresponding to the strip 74. This intermediate strip then adjoins the leading unit 60 integrally by its front end via the strip 65.

Figure 12:
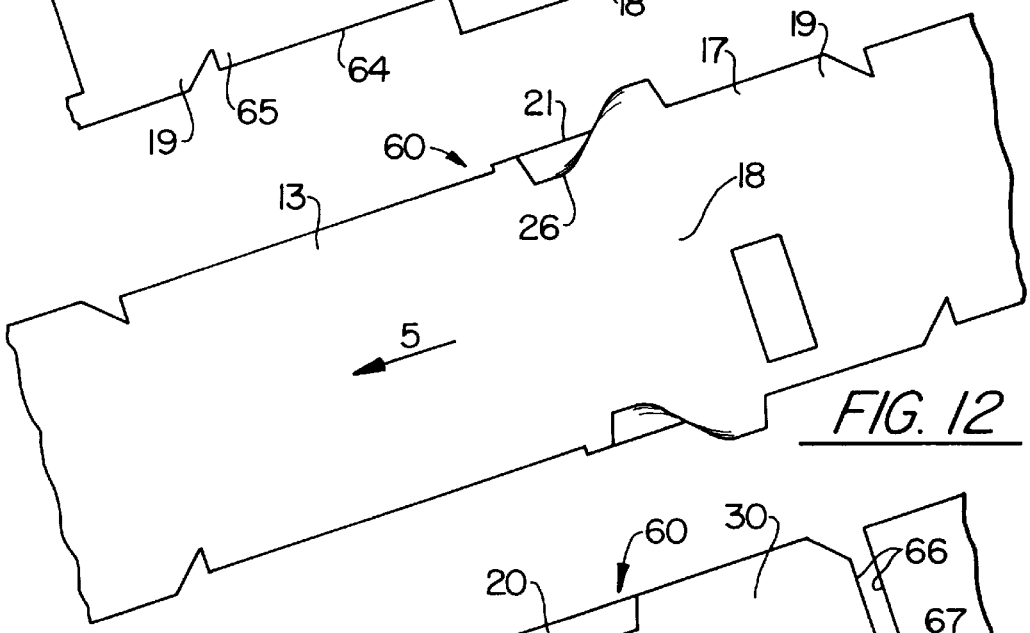

The longitudinal and punched cuts as shown in FIG. 5 or 11 extend continuously over the full length of each unit 60. After these cuts the flaps 20 of the envelope or envelopes 11, 14 are folded on the fly in the device 41, namely through 180° contrary to the direction 5 and over the length thereof progressively up to contact with the inner side 24. In this arrangement the flaps located transversely opposite each other are folded simultaneously as shown in FIGS. 6 and 12 respectively, the folding zone having not been pre-scored by a notch. For folding, the flaps 20 run on corresponding twisted guiding surface areas of the device 41 due to their conveying movement, the flaps 20 sliding and/or rolling on these surface areas.

Figure 13:
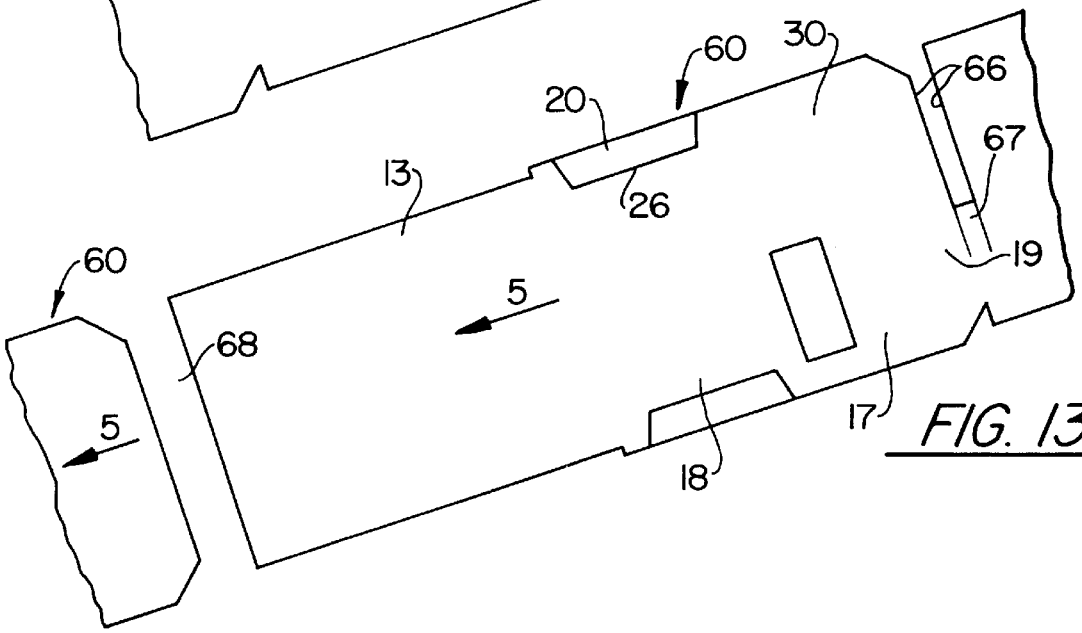

Directly thereafter the units 60 are separated from each other by cross cuts 66 in the device 43 as shown in FIG. 7 or 13, during which and afterwards the location of the units 60 relative to each other is not changed. Between two units 60 still juxtaposed integrally two parallel parting cuts 66 are produced simultaneously with one and the same tool. This tool is a permanently rotating roll with two cutter knife strips mounted directly adjoining on its outer circumference. The spacing of the knives from each other equals the spacing of the parting cuts 66. This spacing is selected so large that between the front end of the unit 60 or of the parts 13, 13' and the flap 19 of the adjoining unit 60 an intermediate strip 67 is parted. The strip 67 includes the multi-ply connecting strip 57 and the single-ply additional strip 65, finalizing the finish cut of the free longitudinal edges of the flap 19 and the front end edge of the parts 13, 13'. At the same time the parts 13, 13' are parted from each other, as a result of which the parts 13, 13' are located on each other merely loosely and unconnected up to the rear end and transverse edge 69 of the ply 13'. However, the mutual joint in the region of this edge 69 continues to ensure that the parts 13, 13' are juxtaposedly located in position. In the configuration as shown in FIGS. 11 to 17 no part 13' is provided or illustrated.

In processing the parts 13' in the device 38, 39 or prior to transferring the corresponding web of material into the storage 39 the parts 13' are likewise printed with markings 56. These marks 56 are located visible on the strip 57 and on the side thereof facing away from the web 31. The marks 55, 56 dictate by their lateral spacings from the longitudinal edges 58, 59 a code, a single line or dot sufficing for each marking 55, 56. The marks 55, 56 associated with each other for the same unit 60 align in the direction 5, are located on sides of the part 13' and of the part 13 or the web 31 facing away from each other and may coincide. Between the devices 38 and 43 and 46 or 47 respectively the marks 55, 56 are machine read by a reader of the device 1 on the fly to detect whether a part 13' is provided with the same personalization as the remaining unit 11, 13. Should an error be detected thereby the corresponding unit 60 is ejected by the device 45 from the plane 4 or from the section 2. The intermediate strip 65. 67 includes both marks 55, 56 which together with the strip 65, 67 are dumped as scrap transversely from the plane 4.

The two knives of the device 43 may comprise a slight inclination relative to the axis of the knife roll, as a result of which the knives cut the units 60 progressively from one side edge to the other, as shown in FIG. 7. Following removal of the strip 67 adjoining units 60 run in sequence with a spacing gap 68 inbetween, the width of which is the same as the width of the strip 67, as a result of which or due to acceleration of the leading unit 60 as shown in FIG. 13 larger gaps 68 materialize. With the gaps 68 the units 60 gain access one after the other to the conveyor 44 and, with the front edge of the unit 60 leading, to the device 46. In this device the front end section of the unit 60 is provided contrary to the direction 5 progressively one after the other with folds 72, 71, 70 as shown in FIG. 8 or FIG. 14. This end section is located in front of the cover sheets 17, 18 adjoining them. The folds are located at right angles to the direction 5 and result in a so-called one-third fold of the contents parts 13, 13'. In this fold each part 13 or 13 forms three plies each located on the other. Should the height of the envelope 11 be more, a half-fold may also suffice, each part 13 or 13' forming only two plies located on each other.

The two parts 13, 13' are folded simultaneously in common in their mutual coincident location, the fold 70 being located between the long defining edges of the strip 74 in the middle of the width thereof or somewhat nearer to the edge 69. This strip 74 is then two or three-ply. The three plies of each part 13, 13 on the inner side 25 are located directly adjacent to the cover sheet 17 as a pack or folded unit 73. In this prefolded condition the flaps 20 are folded inwards. In this folding action the unit 60 is power transferred from the device 46 in the direction 5 into the diverter station as of which it is transported further in the direction 6. To this extent the FIGS. 8 and 9 may be appreciated as constituting a single drawing figure, the diverter station or the axis 50 being located at the intersection of the vertical longitudinal center planes of these two FIGS.

In the method as depicted in FIGS. 14 to 17 the single flaps 20 or double flaps 20, 20' are provided only on the cover sheet 18. In the configuration as shown in FIGS. 5 to 10 they could also be provided only on the cover sheet 17. The single flaps 20 or 20" are folded as explained with respect to FIGS. 6 to 8. Prior to attaining the processing as shown in FIG. 8 or of station 46 the thus prefolded flaps 20 are reopened about their fold, as a result of which the contents part 12 may then be placed as the unit 73 on the inner side 25 without coming into contact with the flaps 20. During exiting of the unit 60 from the station 46 and as long as the trailing cover sheet 17 is still guided by being clamped at both surface area sides in this station, the flaps 20 are re-folded inwards and onto the contents part 13, 73 about their already scored fold 21 so that the flaps 20 run along the guiding curves.

The flaps 20 are then fixedly located in their folded-in position continually in the conveying section 2 or 3 by means of a hold-down 78 included in the movement with low or zero friction at the free sides of the folded-in flaps 20, as a result of which the contents part 13, 73 is continually clamped between the plies 18, 20 unable to shift out of place therefrom. The hold-down 78 is indicated dot-dashed in FIG. 15. The shoe 78 is located in a plane opposite and parallel to that of the supporting and conveying path, on which the cover sheet 18 runs, supported by its outer side. The glue 79 is applied directly following the folding action in the station 46 or during or after the repeat upsweep and full fold-in of the flaps 20. Application of the glue is done in the conveying section 2 by means of an applicator of the type as already described. The glue 79 is applied only to the portions of the inner surface area 24 where applicable later totally covered by the flaps 20. The line of glue 79 is oriented as a line parallel to the direction 5 and its ends are spaced away from the cover sheet 18 as well as from the flap 19.

In the case of the arrangement of the flaps 20, 20', 20" both folds of the flaps 20, 20' are likewise initially prefolded, after which opening up the fold occurs only about the fold between the flap 20 and the cover sheet 18, resulting in the flap 20' remaining in contact with the side of the flap 20 corresponding to the outer side of the cover sheet 18 up to completion of the item 10 as provided for on the finished item 10. Although the counter flaps 20" folded inwards in the same station may be initially folded open again, like the flaps 20 before being return folded inwards, it is expedient that the flaps 20" after having first being folded inwards remain continually so in further passage up to completion as shown in FIG. 17, the glue application 79' then being applied to the side facing away from the inner side 24 on the flaps 20" instead of the glue application 79. In this arrangement FIG. 14 corresponds to FIG. 8, FIG. 15 to the lower illustration of FIG. 9, FIG. 16 to the upper illustration of FIG. 10 and FIG. 17 to the lower illustration of FIG. 10, the closing flap 19 being shown already complete closed.

Immediately on leaving the diverter station or, at the latest, during the progressively processing action contrary to the direction 6 in device 47 the units 60 are guided with hold-downs, like powered conveyor belts. In this case the units 60 run in sequence spaced away from each other. The hold-downs guide not only the underside, but also the top side facing away from the latter of the unit 60, thus preventing the plies 13, 13' from being turned or shifted out of place relative to the plies 17, 19. In the device 47 a slitter is used to part the folded strip 74 including the fold 70 and the connecting zone at the edge 69. The rotating knife of this slitter is arranged on a shaft, this shaft mounting other tools, namely scoring rolls rotating in synchronism with the knives. At the same time as the slit is produced by the rolls on the inner sides 24, 25, notches or straight-line grooves 76, 77 are scored which form the folds 22, 23. Due to this the unit 60 is uniformly loaded widthwise between the flap 19 and the strip 74 by tool engagement, this likewise preventing the cited shifting or turning out of place. The same as in the case of the cuts as shown in FIGS. 5 and 7 or 11 and 13, here too, simultaneously with the cut the strip 74 is dumped transversely from the plane 4 as waste. After parting of the strip 74 the unit 73 is totally released from the cover sheets 17, 18. In this arrangement the interfolded parts 13, 13' or part 13 as shown in FIG. 15 are released from the mutual connection via edge 69 since the latter is included in the parting. In addition the top edge of the cover sheet 18 is finish cut. The unit 73 can be continued to be located in position by a concurrent top tape or balls running in a cage. The hold-down 31 thus formed is expediently narrower than the unit 73.

Figure 16:
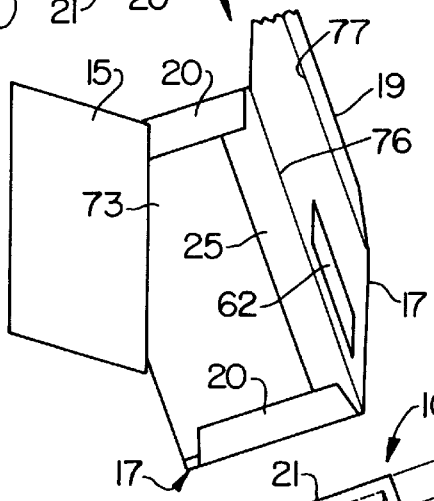

In the station 49, as shown in FIG. 10 at the top or in FIG. 16 at least one enclosure part 14, 15, 16 is power placed on the unit 73 after the cover sheet 17 has been upswept about the fold 22 at right angles transversely to the cover sheet 18 or plane 4 in the longitudinal folder 48 as a result of which the part 15 can be supplied transversely to the direction 6 oriented slantingly downwards before being stopped by its leading end at the inner side 24 or in the fold 22 and then dropping by its own weight into its final packaging position on the unit 18, 73. In this packaging position the supplied part 14, 15, 16 protrudes laterally neither beyond the side edges 64 of the unit 73 nor beyond the outermost defining edges of the unit 73 parallel to the direction 6. In the longitudinal folder 48 the cover sheet 17 is then folded further over the cover sheet 18 until it is located parallel to the cover sheet 18 and on the side of the contents 12 facing away from or the like as shown in the middle illustration in FIG. 10. In this arrangement the cover sheet 18 remains with the contents 12 in the plane 4, the contents 12 adjoining only the free zone 30 and not the flap 20. As a result of this the flaps 20 laterally adjacent to the side edges 64 are pressure bonded to the inner side 25. The flaps 20 are then not bonded to the inner side 24.

In the method as shown in FIGS. 11 to 17 the side flaps 20 as shown in FIG. 11 are punched from the web of material 31 laterally adjoining the cover sheet 18, after which they are folded inwards as shown in FIGS. 12 and 13. On completion of the parting cuts 66 as shown in FIG. 13 the leading unit 60 is slightly accelerated, as a result of which the gap 66 is wider than the strip 67. As illustrated in FIGS. 5 to 9 the straight side edges 64 may extend up to the cut-to-size item for the cover sheet 18 or as shown in FIGS. 11 to 15 displaced outwardly with respect thereto. The ply of the strip 74 belonging to the part 13, 73 is thus narrower than the ply belonging to the cover sheet 18. The hold-down 78 may be so narrow that it does not disturb even when the part 15 is inserted as shown in FIG. 16 and continues to maintain holding down of the flaps 20. When configured correspondingly wider the part 15 may be formed by the strip 74. The part 15 may carry the personalization printing 54 which is then visible from without through the window 62. The width of the part 15 is keenly adapted to the spacing 27 and the height of the part 15 is keenly adapted to the height of the envelope 11, as a result of which the part 15 is unable to slip out of place neither laterally not up or down within the envelope 11 finished as shown in FIG. 17 so that the printing always remains within the definition of the window 62. The longitudinal edges 26 of the flaps 20 act as stops against slipping out of place to the side. The inner sides of the folds 22, 23 act as stops against slipping out of place up or down. In FIG. 17 the contents part 13 is depicted shifted out of place in the direction of the fold 22 as compared to its position as shown in FIGS. 15 and 16. This shift can occur on insertion of the part 15 before or afterwards by corresponding means of the device 1 of the conveying section 3. The flaps 20 can then also not be folded inwards until the cover sheets 17, 18 are located in the closing position as shown in FIG. 10 or on each other, the flaps 20 then clasping the cover sheet 18 or 17 on the outer side. In this arrangement the flaps 20 are secured by glueing on this outer side.

Downstream of the device 49 or 42 and upstream of the device 48 in the section 2 or 3 the device is expediently provided with which glue is applied to the inwards folded flaps for securing the flaps as shown in FIGS. 6 to 10. Application is made on the sides of flaps 20 facing away from the inner side 24 or on the corresponding margin of the inner side 25. In the case of the arrangement as shown in FIGS. 11 to 17 the glue applications 79 or 79' are applied by this applicator. The line of glue 79 may be applied to the flap 20 or the line of glue 79' on the flap 20'. On the inner side of the closing flap 19 glue can be applied on the fly in the device 37, in the applicator last cited or in some other applicator. Once the cover sheets 17, 18 are located parallel in plane on each other the longitudinal folder 48 is used to fold the closing flap 19 like the cover sheet 17 contrary to the direction 6 progressively about the groove 77 in one go through 180° against the rear side of the envelope 11 or outer side of the cover sheet 18 and pressing it to this outer side, thus producing a seal. At the same time the fold 23 is formed and the mailing item 10 finish sealed. Applying the glue to the flap 19 may be done to advantage from underneath when the cover sheets 17, 18 are already folded located on each other. Glueing the side flaps 20 may be done on infeed in the device 46.

The parts 13, 13' coincide in shape on completion, these parts thus being well suited for two pages of a letter. If these parts 13, 13' are not bonded to each other at the edge 69 during trimming as shown in FIG. 9 or 15 the fold as shown in FIG. 8 or 14 has the effect that the edge 69 is retracted relative to the fold 70, as a result of which the trimming cut 75 fails to encounter this edge 69 or the part 13'. The last-but one step in producing the item 10 ready for mailing is unfolding the cover sheets 17, 18, after which all that is required is to fold over the flap 19, thus resulting in very simple production. The web 31 remains intact except for the singling action as shown in FIG. 7 to 13. Accordingly, all of the previous working steps can be executed at high speed and accuracy, it not being until the cross folds 70 to 71 are made that singling into units 60 occurs.

All cited effects and properties may be provided precisely or merely roughly or substantially as described or also in a major departure therefrom for particular applications. All features of all embodiments of the methods, devices and mailing items may be interchangeable, added to or combined with each other.

What is is claimed is:

1. An apparatus (1) for preparing a mailing item (10) collected from a blank unit including first and second blanks from a continuous web (31) and comprising item units (11, 13, 13') including an envelope (11) made from the first blank and an insert (13, 13') made from the second blank and withdrawably enclosed by the envelope (11), said apparatus comprising:

a stationary main frame (52);

a conveyor (32, 42, 44) conveying the web (31) and the first and second blanks along said main frame (52) in a conveying plane (4) and a conveying direction (5, 6), while being conveyed, the web (31) including a leading end section (60) and the blank unit including a leading end edge (66);

processing stations (33 to 41, 43 and 45 to 49) for processing the web (31) and the blank unit while moving in said conveying direction (5, 6), said processing stations distributed along said conveyor (32, 42, 44) and including:

a transverse splitter (43) for transversely severing the leading end section (60) at the leading end edge (66), an inserter (38, 46) for displacing the insert (13, 13') on the blank unit with the leading end edge (66) separate from the leading end section (60), and a closer (48) for wrapping the first blank around the insert (13, 13'), wherein said conveyor (32, 42, 44) includes a conveying path (2, 3) receiving the first and second blanks while being conveyed, and holding means holding the second blank on said conveying path (2, 3) from said transverse splitter (43) to said inserter (46).

2. The apparatus according to claim 1, wherein between said transverse splitter (43) and said inserter (46) said holding means continuously and commonly hold the first and second blanks in said conveying plane (4) while the first blank is juxtaposed with the second blank parallel to said conveying direction (5) and while the first blank is conveyed parallel to said conveying direction (5).

3. The apparatus according to claim 2, wherein in plan view on said conveying plane (4) said inserter (46) displaces the second blank with respect to the first blank parallel to said conveying direction (5) for commonly superimposing the first and second blanks.

4. The apparatus according to claim 1, wherein said transverse splitter (43) commonly severs the first and second blanks from the web (31) while the first blank remains directly connected to and unsevered from the second blank.

5. The apparatus according to claim 4, wherein said processing stations further include a separator (47) located downstream of said transverse splitter (43) and severing the second blank from the first blank substantially parallel to the leading end edge (66).

6. The apparatus according to claim 5, wherein said separator (47) is located downstream of said inserter (46).

7. The apparatus according to claim 6, wherein said inserter (46) is a folder folding the second blank on the first blank around a transverse fold (70), said separator (47) commonly severing the fold (70) from both the first and second blanks.

8. The apparatus according to claim 5, wherein in plan view on said conveying plane (4) said conveying direction includes a first direction (5) and a second direction (6) oriented substantially transverse to said first direction (5), said transverse splitter (43) severing the leading end edge (66) while the first and second blanks are conveyed parallel to said first direction (5), said separator (47) severing the second blank from the first blank parallel to said second direction (6) while the first and second blanks are superimposed and conveyed parallel to said second direction (6).

9. The apparatus according to claim 8, wherein said separator (47) is located upstream of said closer (48).

10. The apparatus according to claim 1, wherein the first blank includes a first panel (17) and a second panel (18) superimposed by the first panel (17) while said closer (48) closes the first and second panels (17, 18) around the insert (13, 13'), the envelope (11) including an end flap (19) superimposed on the second panel (18), and wherein said processing stations further include a superimposer (48) displacingly superimposing the end flap (19) onto the second panel (18), said conveying direction (5, 6) including a subdirection (6) which is unidirectional through said superimposer (48) and through said closer (48) when seen in plan view on said conveying plane (4).

11. The apparatus according to claim 10, wherein said subdirection (6) is oriented substantially parallel to the leading end edge (66), said subdirection (6) being continuously linear from said closer (48) to said superimposer (48) when seen in the plan view, said superimposer (48) folding the end flap (19) while directly connected to the first panel (17).

12. The apparatus according to claim 1, wherein the first blank includes a first panel (17) and a second panel (18) superimposed by the first panel (17) while the closer (48) closes the first and second panels (17, 18) around the insert (13, 13'), the envelope (11) including a side flap (20) interconnecting the first and second panels (17, 18) at an angle to the leading end edge (66), and wherein said processing stations further include a flap displacer (41) located upstream of said transverse splitter (43) and superimposing the side flap (20) onto at least one of the first and second panels (17, 18) while still directly interconnected with and unsevered from the web (31).

13. The apparatus according to claim 12, wherein said inserter (46) is located downstream of said flap displacer (41) and superimposes the insert (13, 13') onto the first blank while the side flap (20) is superimposed with at least one of the first and second panels (17, 18), said inserter (49) superimposing the insert (13, 13') apart from the side flap (20).

14. The apparatus according to claim 12 and further including means for reopening the side flap (20) downstream of said flap displacer (41) and upstream of said inserter (46), wherein said processing stations further include a reclosing station located downstream of said inserter (46) for superimposing the side flap (20) onto the insert (13, 13').

15. The apparatus according to claim 12, wherein said processing stations further include a contour trimmer (40) for laterally trimming the first and second blanks while still directly interconnected with and unsevered from the web (31), said contour trimmer located upstream of said flap displacer (41).

16. The apparatus according to claim 12, wherein said processing stations further include an adhesive applicator (37) for coating the first blank with an adhesive while the first blank is still interconnected with the second blank, said adhesive applicator located upstream of said inserter (46).

17. The apparatus according to claim 16, wherein said adhesive applicator (37) is located upstream of said transverse splitter (43) and coats the first blank while still directly interconnected with the web (31).

18. The apparatus according to claim 16, wherein said conveyor (32, 42, 44) includes a first conveyor (32) and a second conveyor (42) located downstream of said first conveyor (32) and upstream of said transverse splitter (43), said conveyor holding the web (31) longitudinally continuously tensioned from said first conveyor (32) to said second conveyor (42), said adhesive applicator (37) being located between said first and second conveyors (32, 42).

19. The apparatus according to claim 1, wherein said processing stations further include a contour trimmer (40) for laterally trimming the first and second blanks while still directly interconnected with and unsevered from the web (31), said contour trimmer located upstream of said transverse splitter (43) located upstream of said transverse splitter (43).

20. The apparatus according to claim 1, wherein said inserter (38) is located upstream of said transverse splitter (43) and deposits the insert (13') on the blank while directly interconnected with and unsevered from the web (31).

21. The apparatus according to claim 20, wherein said processing stations further include means (37) adhesively interconnecting the blank unit with the insert (13') at said inserter (38).

22. The apparatus according to claim 20, wherein said processing stations further include a contour trimmer (40) for laterally trimming the second blank commonly with the insert (13'), said contour trimmer located downstream of said inserter (38).

23. The apparatus according to claim 12, wherein said inserter (38) is located upstream of said flap displacer (41).

24. The apparatus according to claim 21, wherein said processing stations further include a separator (47) for severing the insert (13') from the first blank, said separator located downstream of said inserter (38).

25. The apparatus according to claim 1, wherein said processing stations further include a turner (36) for inverting the web (31) upside down while being longitudinally conveyed, the web (31) including a first web face and a second web face remote from the first web face, said turner located upstream of said inserter (38, 46).

26. The apparatus according to claim 25, wherein said processing stations further include a printer (34) for printing the first web face, the printer located upstream of said turner (36).

27. The apparatus according to claim 26, wherein upstream of said turner (36) the first web face is an upper face of the web (31), said processing stations further including at least one layer applicator (37, 38, 41) for applying a layer (57, 13', 20) on the second web face, said at least one layer applicator located downstream of said turner (36).

28. The apparatus according to claim 5, wherein said processing stations further include a shunt (45) for sorting out faulty ones of the blank units while the first and second blanks are still directly interconnected, said shunt located downstream of said transverse splitter (43) and upstream of said separator (47).

29. The apparatus according to claim 28, wherein said shunt (45) is located downstream of said inserter (38).

30. The apparatus according to claim 1, wherein the web (31) includes a plurality of the blank units juxtaposed transverse to the web (31) and parallel to the conveying plane (4), said processing stations further including a divider (40) for subdividing the web (31) into laterally juxtaposed individual webs each including a plurality of the blank units lined up longitudinally with respect to the web (31), said divider located upstream of said transverse splitter (43).

31. The apparatus according to claim 30, wherein said divider (40) is a contour trimmer laterally non-linearly trimming the first and second blanks while still directly interconnected with and unsevered from the web (31).

32. The apparatus according to claim 1, wherein the blank unit and the insert (13') include first and second marks (55, 56) commonly defining a reference code, mark reading means being included and automatically reading the first and second marks before at least one of the first and second blanks is finally severed.

33. The apparatus according to claim 32, wherein said processing stations further include:

a separator (47) for severing the second blank from the first blank, said separator located downstream of said transverse splitter (43); and a shunt (45) for sorting out faulty ones of the blank units, said shunt located upstream of said separator (47).

34. An apparatus for preparing a mailing envelope (11) from a blank from a continuous web (31) and comprising envelope sections (17, 18, 19, 20) including a first panel (17), a second panel (18) covering the first panel (17) and a side strip (20) laterally directly interconnecting the first and second panels (17, 18), said apparatus comprising:

a stationary main frame (52);

a conveyor (32, 42, 44) conveying the web (31) and the blank along said main frame (52) in a conveying plane (4) and first and second conveying directions (5, 6), while being conveyed with respect to said first conveying direction (5), the web (31) including a leading end section (60) and the blank including a leading end edge (75); and processing stations (33 to 41, 43 and 45 to 49) for processing the web (31) and the blank while moving in said first and second conveying directions (5, 6), said processing stations distributed along said conveyor (32, 42, 44) and including a contour trimmer (40) for laterally trimming the blank, a transverse splitter (43) for transversely severing the blank from the web (31), said transverse splitter located downstream of said contour trimmer (40), and a closer (48) mutually superimposing and adhesively interconnecting the blank's first and second panels (17, 18), said conveyor includes a first conveyor (32) and a second conveyor (42) located downstream of said first conveyor (32) and upstream of said transverse splitter (43), said conveyor holding the web (31) longitudinally continuously tensioned from said first conveyor (32) to said second conveyor (42), said conveyor including a first conveying path (2) defining said first conveying direction (5) and including said first and second conveyors (32, 42), said transverse splitter (43) and said contour trimmer (40), said first conveying path (2) conveying the blank with the first and second panels (17, 18) juxtaposed parallel to said first conveying direction (5), said conveyor including a second conveying path (3) connecting downstream directly to said first conveying path (2) and defining said second conveying direction (6) oriented transverse to said first conveying direction (5) when seen in plan view on said conveying plane (4), said second conveying path (3) including said closer (48).

35. The apparatus according to claim 34, wherein the envelope sections further include an end flap (19) connected to the first panel (17) and covering the second panel (18), and wherein said processing stations further include a superimposer (48) displacingly superimposing the end flap (19) onto the second panel (18), said second conveying path (3) including said superimposer (48).

36. The apparatus according to claim 34, wherein the side strip is a side flap (20) interconnecting the first and second panels (17, 18) at an angle to the leading end edge (75), and wherein said processing stations further include a flap displacer (41) for superimposing the side flap (20) onto at least one of the first and second panels (17, 18) while still directly interconnected with and unsevered from the web (31) and while being conveyed parallel to the first conveying direction (5), said flap displacer located upstream of said transverse splitter (43), said first conveying path (2) including said flap displacer (41).

37. The apparatus according to claim 34, wherein said processing stations further includes:

a turner (36) for inverting the web (31) upside down while being longitudinally conveyed, said turner located upstream of said transverse splitter (43), the web (31) including a front face and a rear face remote from the front face, a first layer applicator (34) for applying a layer (54) onto the front face and said second layer applicator (37, 38, 41) applying a layer (57, 13', 20) onto the rear face of the web (31), said first layer applicator located upstream of said turner (36) and a second layer applicator (37, 38, 41) located downstream of said turner (36), said first conveying path (2) including said first and second layer applicators (34, 37, 38, 41) between said first and second conveyors (32, 42).

38. The apparatus according to claim 34, wherein the web includes a plurality of the blanks juxtaposed transverse to the web (31) and parallel to said conveying plane (4), and wherein said processing stations further include a divider (40) for subdividing the web (31) into laterally juxtaposed individual webs each including a plurality of the blanks lined up longitudinally with respect to the web (31), said divider (40) located upstream of said transverse splitter (43) and located between said first and second conveyors (32, 42).

39. The apparatus according to claim 38, wherein said divider (40) non-linearly subdivides the web (31) into more than two of the individual webs.

40. The apparatus according to claim 34, further including a first base unit and a second base unit displaceable with respect to said first base unit about a setting axis (50) oriented transverse to said conveying plane (4), said first base unit includes said first conveying path (2) and said second base unit includes said second conveying path (3), said second conveying path (3) being displaceable with respect to said first base unit to be oriented in-line with said first conveying path (2), said setting axis (50) being located between said transverse splitter (43) and said closer (48).

* * * * *